US008851943B2

(12) United States Patent
Zapata

(10) Patent No.: US 8,851,943 B2
(45) Date of Patent: Oct. 7, 2014

(54) MOTORIZED WATER VEHICLE ADAPTED FOR SUPPLYING A PRESSURIZED FLUID AND ASSOCIATED DELIVERY SYSTEM

(71) Applicant: Zapata Holding, Le Rove (FR)

(72) Inventor: Frankie Zapata, Le Rove (FR)

(73) Assignee: Zapata Holding, Le Rove (FR)

( * ) Notice: Subject to any disclaimer, the term of this patent is extended or adjusted under 35 U.S.C. 154(b) by 0 days.

(21) Appl. No.: 14/212,576

(22) Filed: Mar. 14, 2014

(65) Prior Publication Data

US 2014/0196650 A1 Jul. 17, 2014

Related U.S. Application Data

(63) Continuation-in-part of application No. 13/837,439, filed on Mar. 15, 2013, which is a continuation of application No. PCT/FR2012/050877, filed on Apr. 20, 2012.

(30) Foreign Application Priority Data

Sep. 19, 2011 (FR) ..... 11 58297

(51) Int. Cl.
*B63H 11/08* (2006.01)
*B63B 35/73* (2006.01)

(52) U.S. Cl.
CPC ..... *B63B 35/731* (2013.01)
USPC ..... 440/39

(58) Field of Classification Search
USPC ..... 440/38, 39, 40
See application file for complete search history.

(56) References Cited

U.S. PATENT DOCUMENTS

| | | | | |
|---|---|---|---|---|
| 3,243,144 | A | 3/1966 | Hulbert et al. | |
| 3,277,858 | A | 10/1966 | Athey | |
| 3,381,917 | A | 5/1968 | Moore et al. | |
| 5,299,960 | A | 4/1994 | Day et al. | |
| 6,146,219 | A | 11/2000 | Blanchard | |
| 6,168,481 | B1 * | 1/2001 | Mardikian | 440/39 |
| 6,343,964 | B1 * | 2/2002 | Mardikian | 440/39 |
| 6,514,107 | B1 * | 2/2003 | Sparrow | 440/39 |
| 7,258,301 | B2 | 8/2007 | Li | |
| 2002/0077008 | A1 | 6/2002 | Koyano et al. | |
| 2008/0014811 | A1 | 1/2008 | Zeyger | |

* cited by examiner

*Primary Examiner* — Lars A Olson
(74) *Attorney, Agent, or Firm* — Buchanan Ingersoll & Rooney PC

(57) ABSTRACT

A Motorized Water Vehicle (MWV) adapted to operate as a fluid-compression station in addition to the primary transport function thereof. Such an MWV can supply compressed fluid to a third device. In a preferred and non-exhaustive manner, such an MWV can supply a passenger propulsion device allowing the propulsion device to move through the air or through a fluid. A propulsion system is thereby provided, in which a remote station is a motorized water vehicle adapted to engage with a propulsion device.

13 Claims, 5 Drawing Sheets

MOTORIZED WATER VEHICLE ADAPTED FOR SUPPLYING A PRESSURIZED FLUID AND ASSOCIATED DELIVERY SYSTEM

The invention relates to the adaptation and use of a Motorized Water Vehicle (MWV) to operate as a fluid-compression station in addition to the primary transport function thereof. Such an MWV can thus supply said compressed fluid to a third device. In a preferred and non-exhaustive manner, such an MWV can supply a passenger propulsion device allowing the latter to move through the air or through a fluid.

Moving through space has always been one of the main dreams of mankind. Many machines have been produced, each more sophisticated than the last, which aim to achieve this dream with greater or lesser success.

Thus, in order to attempt to move with ease through environments as diverse as the surface of water or in contact with a sometimes hostile environment, a propulsion device such as described in the 1960s in U.S. Pat. Nos. 3,243,144 or 3,381,917 comprises a body in the form of a harness or a seat on which or in which a passenger can be positioned. Such a body engages with a thrust unit in particular in the form of a pair of nozzles for ejecting a fluid under pressure and thus to generate a thrust force. In order to simplify the flight of the passenger and to reduce the physical effort thereof, the nozzles are arranged above the centre of gravity of the body-passenger assembly, specifically at the height of the passenger's shoulders. The unit also includes a fluid-compression station supplied with flammable liquids or gases and positioned on the back of the passenger. Said station is capable of supplying enough thrust to cause the passenger to take off, transformed into a type of human rocket. The low operating range coupled with the dangerousness of such devices have caused them to remain relatively confidential.

More recently, a device such as described in U.S. Pat. No. 7,258,301 and US patent application 2008/0014811 A1 draws inspiration from said teaching, adapting it to reduce the dangerousness of the system. The compression station in this case is remote and generally dedicated. Furthermore, the pressurized fluid is water compressed by said station, drawing inspiration in this regard in particular from experiments aiming to use compressed water to reduce the physical effort of a deep-sea diver, as suggested in U.S. Pat. No. 3,277,858.U.S. Pat. No. 7,258,301 and US patent application 2008/0014811 A1 thus propose an airborne propulsion device that is similar to its predecessor, adapted such that pressurized water is transported from a remote compression station by means of a supply channel such as a fire hose. The configuration of the nozzles as well as the means that makes it possible to direct said nozzles in order to determine the trajectory of the device are deliberately kept in order to maintain certain ease of piloting for the passenger. However, in particular the take-off phase requires the passenger to be in an initial standing position, with the feet on a solid surface. The physical effort of the passenger to move, reduced to the simplest expression thereof, is detrimental to the freedom and the variety of movements on the surface of the water or under the surface thereof. Furthermore, such a "device+station" system in accordance with U.S. Pat. No. 7,258,301 is expensive due to the design of the device comprising hinged nozzles, and to the design of a dedicated compression station. The fact of being able to move through space has an intrinsic recreational side. However, the configuration of the nozzles located above the centre of gravity of the device gives the passenger the impression of hanging by the shoulders from a virtual crane hook, and thus deprives the passenger of many sensations: falls, improvised or acrobatic style figures. Furthermore, the variety of directions and movements is limited. It is not easy, for example, to move "crabwise" with a known device, or to change instantly from a straight trajectory on the surface of the water to a diving phase followed by multiple movements under the surface of the water.

In order to address these drawbacks, the manufacturer ZAPATA RACING has designed a device that breaks with the prior art. Such a device comprises mainly a substantially planar platform on which one or more passengers can be positioned. The take-off and the movements are generated by a thrust force supplied by a set of at least three nozzles, two of which are free and intended for being held by one of the passengers, said nozzles all being arranged such as to be positioned below the centre of gravity of the "device-passengers" assembly. It is therefore thanks to their physique and their agility that the passengers of a device according to the invention can control the thrust of the device and perform movements and acrobatics with very large freedom and an unrivalled recreational side.

Such a device can be supplied by any type of fluid-compression station. Like a device according to US patent application 2008/0014811 or according to U.S. Pat. No. 7,258,301, a dedicated remote compression station can be used to supply compressed water to the thrust unit of the ZAPATA RACING propulsion device.

The design of such a dedicated station is expensive or requires the use of third devices (such as a boat) for towing said station or device. In order to reduce such cost, the invention provides for the remote compression station to be able to be an apparatus which has a main original function other than supplying a pressurized fluid to a propulsion device. It is therefore possible to make use of the natural fluid-compression capacity of a motorized water vehicle (MWV) such as, for example, the RUNABOUT MZR 2011 edition, manufactured by ZAPATA RACING—without any major adaptations.

Among the many advantages of the invention, it can be mentioned that the invention makes it possible:

- to make available to users a highly recreational system which, after learning, becomes easy to use, offering a broad range of applications;
- to use motorized water vehicles to supply a pressurized fluid;
- to provide recreational (jousting, acrobatics, etc.) as well as civil or military security applications;
- to preserve the buoyancy of a motorized water vehicle used as a compression station when the latter is towed by a propulsion device, regardless of the choppiness of the body of water over which the system travels, and to prevent the risk of immersion of said vehicle and to assist the navigation thereof;
- easily to return to the original use of the vehicle by disconnecting it from a third device previously supplied with a pressurized fluid.

For this purpose, the invention provides a method for adapting a motorized water vehicle comprising a hull, a propulsion means using a turbine to compress a fluid ingested from an intake and expelling said fluid thus pressurized from a fluid outlet at the rear of said vehicle. In order to use the compression capacity for purposes other than the transport of passengers, the method comprises a step of positioning on the fluid outlet a flange engaging with a supply channel in order to transport all or part of the pressurized fluid.

In order avoid the risk of immersion during optional towing of the MWV, in order to supply the compressed fluid easily or further to prevent the supply channel from obstructing all or part of the fluid intake of the vehicle when said channel is positioned along the hull of the vehicle from the rear to the front thereof, the method can advantageously comprise a step of inserting between the flange and the supply channel an elbow arranged for shifting the supply channel sidewise relative to the axis of the fluid outlet and for directing said channel towards the front of the vehicle as well as a step of guiding the supply channel along the hull up to the bow of the vehicle.

According to a second aspect, the invention provides a motorized water vehicle comprising a hull, a propulsion means using a turbine to compress a fluid ingested from an intake and expelling said fluid thus pressurized from a fluid outlet at the rear of said vehicle. In order to avoid the risk of immersion during optional towing of the vehicle or to supply the compressed fluid easily, such a vehicle comprises a means for collecting all or part of the pressurized fluid and for carrying the latter to the front of the vehicle and a means for supplying the pressurized fluid from the front of the vehicle.

According to a first embodiment which minimizes the number of adaptations, the means for collecting and carrying a pressurized fluid according to the invention can consist of a flange attached to the fluid outlet connected to a supply channel.

As an alternative, said collection and transport means can consist of a means for diverting the pressurized fluid from the fluid outlet to at least one longitudinal recess made in the hull of the vehicle. According to said alternative, the supply means comprises a bow fitting engaging with said at least one recess.

In order to supply a compressed fluid to a remote device, the bow fitting of a vehicle according to the invention can be arranged such as to be connected to a supply channel.

In order not to strain the link between the vehicle and the supply channel during the movements of a remote device supplied by a vehicle according to the invention, the bow fitting can be arranged such as to enable free rotation about the longitudinal axis of the supply channel.

In order to offer, for example, large freedom of operation to the passenger of a propulsion device designed by the manufacturer ZAPATA RACING, a vehicle according to the invention can also comprise a means for adjusting the compression power of the propulsion means from a remote control.

According to a third aspect, the invention provides, as a preferred use, a propulsion system characterised by a propulsion device comprising a body arranged for holding a passenger and engaging with a thrust unit supplied with a pressurized fluid from a motorized water vehicle according to the invention.

Advantageously, such a system can comprise a supply channel connected by one end to the device and by the other end to a vehicle in order for said vehicle to supply the pressurized fluid to said device via said supply channel.

Other characteristics and advantages will appear more clearly when reading the following description and referring to the appended drawings, among which:

Figure 1:
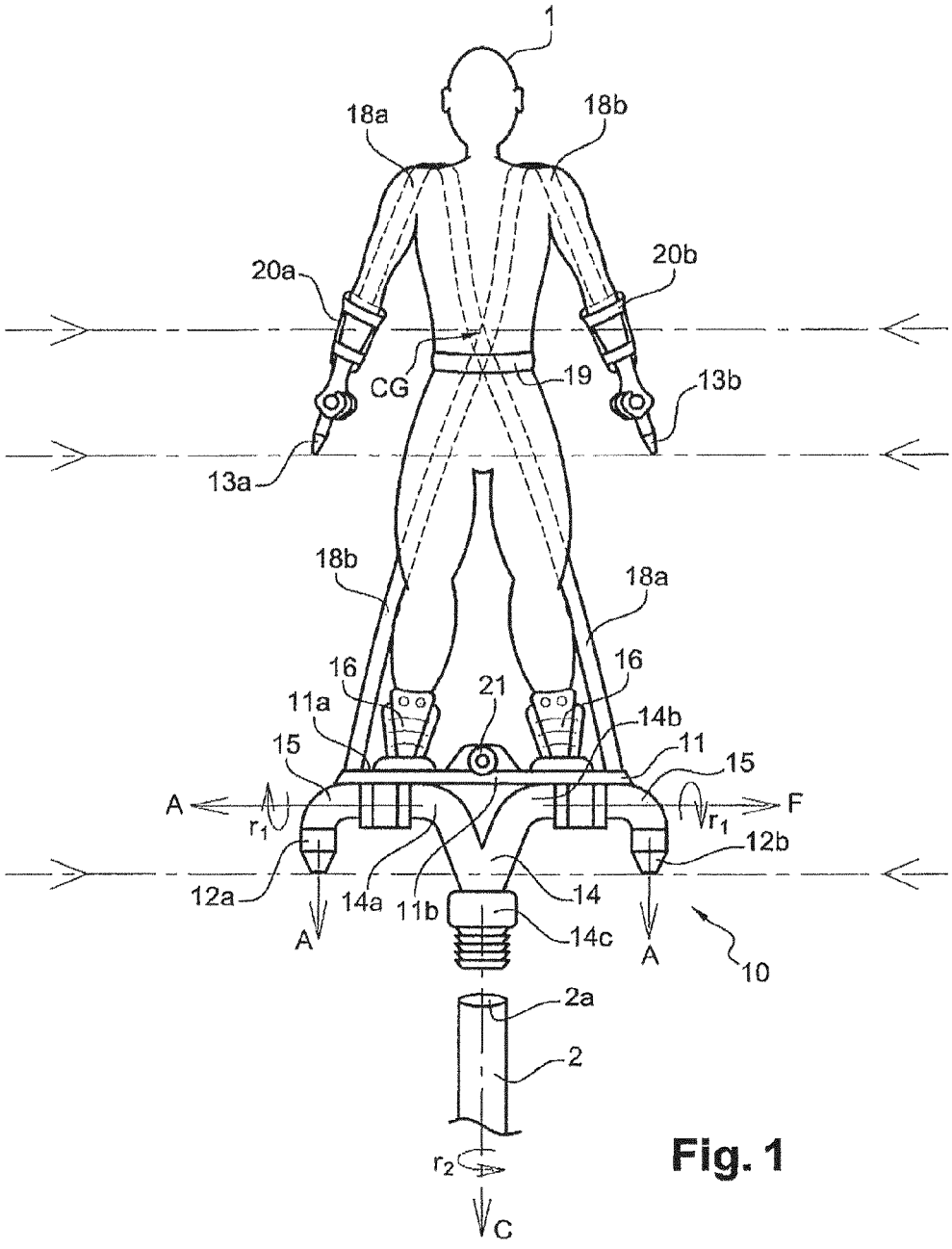
FIG. 1 shows a propulsion device.

FIG. 1 shows an embodiment of a propulsion device 10 designed by manufacturer ZAPATA RACING. Said device comprises a main body in the form of a substantially planar platform 11. Said platform comprises a top surface 11*a* on which a passenger 1 can be positioned. According to the size of the platform and the power of the device, a plurality of passengers can optionally be positioned simultaneously on the top surface 11*a* of said platform 11. The platform can be advantageously made from one material or a plurality of materials having, alone or in combination, enough rigidity to withstand the weight of the passenger or passengers and thus to prevent excessive warping. It may be preferable for said platform to be made of one material in order to determine the buoyancy of the device when the latter is submerged. According to the embodiments, the platform can thus have one or more cavities filled with air or a vacuum in order to improve the buoyancy thereof. As an alternative, it may be preferable not to include vacuum or cavities or to include a ballast in order to make it easier to move under the surface of a fluid. Such a platform can comprise one or more elements engaging with one another or separate.

The propulsion device described in connection with FIG. 1 comprises a thrust group engaging with the platform 11. In the present document, the term "nozzle" has been used to define a profiled duct element for increasing the speed of a flowing fluid. The term "jet pipe" could also be used to describe such an element. This speed increase of the fluid is mainly caused by a difference in cross-section between the intake and the outlet of the element, the outlet having a smaller cross-section than the intake. According to FIG. 1, such a unit consists of a pair of main nozzles 12*a* and 12*b* attached to the bottom surface 11*b* of the platform 11. As an alternative, a single main nozzle attached substantially at the centre of the bottom surface 11*b* of the platform may be preferred over the pair 12*a*, 12*b*.The recreational nature of the use of the device by a passenger can thus be increased. In general terms, the manufacturer does not provide a limit on the number of main nozzles located under the bottom surface 11*b* of the platform 11. The thrust unit thus comprises at least one main nozzle engaging with said bottom surface. Said at least one main nozzle 12*a*, 12*b* is attached by any means to the platform, with no degree of freedom. In order to assist the take-off of the device, the direction of every main nozzle advantageously follows an axis A preferably substantially perpendicular to the bottom surface of the platform such that a main nozzle expels a pressurized fluid from near the bottom surface 11*b* of the platform 11 and away from same. The thrust unit of such a device can also comprise two secondary nozzles 13*a* and 13*b* in order to make said device easier to handle. The latter are free and respectively intended for being held by the forearms or the hands of a passenger 1. The "platform, thrust unit and passenger(s)" assembly has a centre of gravity CG when said assembly is straightened out vertically such as indicated in FIG. 1. Unlike in the prior art, in which the nozzles of the thrust unit are necessarily positioned above said centre of gravity CG in order to minimise the physical effort of the passenger and to simplify the movements thereof, the main and secondary nozzles of the thrust unit of a device 10 are positioned below said centre of gravity CG. A passenger of such a device 10 has the task of positioning and directing the secondary nozzles 13*a* and 13*b* with his or her hands and arms and the main nozzle or nozzles 12*a* and 12*b* by playing with the inclination of the platform using his or her feet, legs, pelvis and torso in order to pilot the propulsion device. The agility of the passenger as well as his or her physical fitness thus maximise the sensations provided and make it possible to perform movements, trajectories and acrobatic figures, whether intended or accidental.

In order to supply sufficient thrust force and enable take-off and movement, the device 10 also comprises a means for collecting and distributing a pressurized fluid (for example water) to the main and secondary nozzles. Such a fluid is preferably transported by a flexible supply channel 2 from a remote compression station—not shown in FIG. 1. Such a supply channel can be manufactured from a fire hose or from any other material that offers the necessary strength against the pressure exerted by the pressurized fluid. A collector 14 can thus comprise a base 14*c* to which an end piece 2*a* of a supply channel 2 connects, for example by means of a flute adapted such as to receive said channel 2. The diameter of said base 14*c* must be adapted to the diameter of the end piece 2*a* of the supply channel 2. According to FIG. 1, the collector 14 can be approximately T-shaped in order to collect the pressurized fluid from the base 14*c* and to distribute same via arms 14*a* and 14*b* to the main nozzles 12*a* and 12*b*.The collector 14 can be connected to the main nozzles rigidly or via an optional linking elbow 15 in order to direct the main nozzles according to an axis A substantially perpendicular to the bottom surface 11*b* of the platform 11. The arms can, as an alternative, be connected to said main nozzles—via the optional elbow 15—by a knuckle or pivot joint on the arms 14*a* and 14*b*.Such an arrangement enables free rotation r1 according to an axis F substantially parallel to the arms 14*a* and 14*b* of the collector 14. Thus, said collector can describe an almost free rotation r1 about said axis F, modulo the abutment represented by the bottom surface 11*b* of the platform 11 during an excessive inclination thereof. A relative rotation r1 of the collector about the axis F with respect to the plane of the bottom surface of the platform 11, after the collector links with the supply channel 2, does not lead to the rotation of the platform 11. Similarly, the end piece 2*a* of the supply channel 2 can advantageously engage with the collector 14 at the base thereof 14*c* via a knuckle or pivot joint in order to enable free rotation r2 about an axis C substantially parallel to the channel 2. The device can thus swivel freely about said axis C without causing loops or excessive strain on the supply channel 2.

The T-shaped configuration—described as a preferred example in relation to FIG. 1—of the collector 14, comprising a base 14*c* and two diametrically opposed arms 14*a* and 14*b*, can obviously be different in the case of a device 10 which only has, for example, a single main nozzle. The collector 14 in this case would be configured as an elbow, like a "⌈", in order to collect—from a base 14*c*—and supply—via an arm 14*a*—the pressurized fluid from the supply channel 2 towards the main nozzle by means of an optional linking elbow 15 engaging with the arm of the collector as well as with the main nozzle. Advantageously, knuckle or pivot joints at the base 14*c* and the single arm 14*a* of the collector 14 are advantageously preferred for the reasons stated above.

In order to distribute the pressurized fluid to the secondary nozzles 13*a* and 13*b*, as an example and as indicated in FIG. 1, for secondary channels 18*a* and 18*b*—in the advantageous form of flexible pipes—can be provided for supplying said pressurized fluid from the collector 14 to the secondary nozzles. In order not to disturb the passenger 1, said secondary nozzles can be guided along the back until the shoulders by using supporting means 19 (straps, harness, etc.). A passenger can also use a means for restraining the secondary nozzles on the forearms of the passenger. Thus, in connection with FIG. 1, an assembly 20*a* and 20*b* of elements comprising a body for engaging with a forearm and a secondary nozzle and/or a secondary channel supplying said secondary nozzle can be attached by means of straps or any other type of attachment to each forearm of the passenger 1. It is easier for the passenger to hold a secondary nozzle.

The platform 11 can comprise a means for maintaining a passenger on the top surface 11*a* of said platform. Thus, according to the preferred position of a passenger on the platform, said maintaining means can consist—as shown in FIG. 1—of a pair of shoes or boots with a binding such as that which is used, for example, when practising wakeboard. Other types of maintaining means may be preferred according to whether it is desirable to assist the passenger in a position with bent legs, kneeling or even sitting.

In order to assist the take-off and, in general terms, the use of such a device, the main nozzle or nozzles as well as the secondary nozzles may be arranged such that the thrust unit thus formed supplies the majority of the thrust force thereof from the main nozzle or nozzles to the detriment of the secondary nozzles. For this purpose, the configuration of the nozzles (cross-sections of the respective intakes and outlets of said nozzles) may be selected in order preferably to supply around 80% of the thrust force from the main nozzle or nozzles. Any other configuration of the thrust unit may be selected in order to adapt the distribution of the thrust force between the main and secondary nozzles. A platform 11 can also be arranged such that the bottom surface 11*b* thereof can engage with a projecting means 17 in turn arranged to offer protection for the elements of the device located under the bottom surface 11*b* of the platform 11, in a non-exhaustive manner: the main nozzle or nozzles, the means for collecting and distributing a pressurized fluid. Such projecting means can thus form supporting points and constitute a protective cage for said elements. Any untimely impact or other direct contact between said elements and the immediate non-fluid environment thereof can thus be prevented, in particular during take-off or landing from dry land, or even when landing on water from shallow water.

The selection of the material or materials used for manufacturing the projecting means can be determined by the required level of impact protection, the resistance to the weight exerted by the passenger or passengers on the platform during the take-off, landing or water-landing phases. The projecting means can also interact with the desired buoyancy of the device according to the structure and configuration thereof.

A passenger of such a propulsion device can perform a presently unrivalled number of movements (in the air, under the surface of an aquatic medium, etc.). In order to ensure easy piloting for the passenger and to grant an increased range of action, the invention provides for a propulsion device to be able also to comprise a means for controlling the power of the compression station. Thus, when receiving an order supplied by said means and carried by an adapted fixed or wireless communication means, the station can modulate the compression power of the fluid it supplies to the propulsion device. The passenger can thus control, for example, the take-off, or even fine-tune the movements thereof by modulating the pressure of the fluid flowing through the supply circuit connecting same to the compression station.

Furthermore, according to the applications or uses of such a propulsion device, the latter can also comprise a means 21 (for example in the form of a nozzle) for spraying a pressurized fluid other than that used to move the device or derived from same. Said optional means advantageously engages with platform 11 or, alternatively, with the passenger (on a shoulder, at the waist, etc.). The purpose herein is to offer a civil security application such as fire-fighting, for example, or even for water games: spraying third parties, novel jousting in which the jet of the second fluid forms a non-solid lance, preventing the risk of injuries while maintaining its function of destabilizing an adversary.

A propulsion device, for instance such as the device 10 described in connection with FIG. 1, can be supplied by any fluid-compression station as soon as the latter is capable of supplying a fluid with high enough pressure for the operation of the propulsion device. The latter can be dedicated to said use at the risk of increasing the overall cost of a propulsion system comprising a propulsion device, a compression station and a supply channel engaging with said device and station in order to transport the pressurized fluid.

In order to reduce such cost, the invention provides for the compression station to be able to be an apparatus which has a main original function other than supplying a pressurized fluid to a propulsion device. It is therefore possible to make use of the natural fluid-compression capacity of a motorized water vehicle (MWV) such as, for example, the RUNABOUT MZR 2011 edition, manufactured by ZAPATA RACING. A motorized vehicle of this type is sometimes also known as a personal water craft or a jet-ski.

Figure 2:
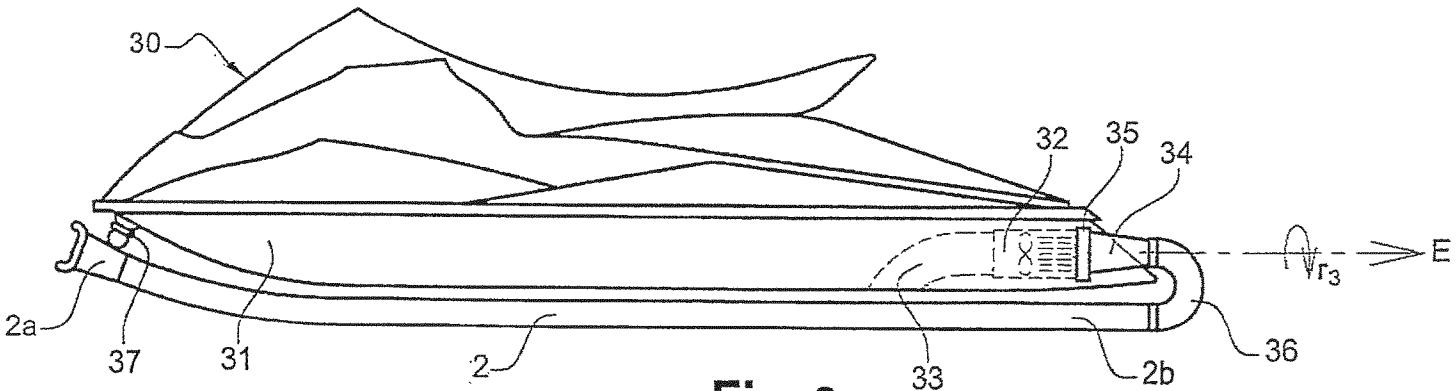
FIG. 2 shows a side view of a remote compression station in the form of a motorized water vehicle adapted according to the invention.

Such a vehicle 30—a side view of which is described in relation to FIG. 2—comprises a hull 31 and houses a propulsion means 32 using a turbine to compress a fluid (the MWV navigating on the surface thereof) ingested from an intake 33 arranged under the hull 31. Said pressurized fluid is expelled from a fluid outlet 34 located at the rear of the vehicle. Such a fluid outlet is generally provided in the form of a cone engaging with a steering system (not shown in FIG. 2) for modifying the trajectory of the MWV. The means 32 is generally driven by an internal combustion engine, also not shown in FIG. 2. The invention thus provides for adapting such an MWV in order to divert the original function of the propulsion means in order for the latter to output a pressurized fluid and supply, for example, a propulsion device according to the invention. The latter provides an adaptation method which consists, for example, of positioning and applying a flange 35 to the fluid outlet 34 of the MWV. Said flange can be designed such as to be capable simply of adapting to the fluid outlet of any MWV or, alternatively, to be specific for one type of fluid outlet, if the latter varies from one MWV to another. According to a first embodiment, the adaptation method also consists of connecting to said flange 35 an end piece 2*b* of a supply channel for transporting the pressurized fluid expelled from the MWV fluid outlet. According to the invention, such an adaptation method makes it possible ultimately to connect the other end 2*a* of said supply channel 2 to the means 14 for collecting and distributing the pressurized fluid to the nozzles of a propulsion device according to the invention, such as the device described in connection with FIG. 1. The MWV can then interact with such a device as a remote compression station. The propulsion device can then travel through the air or under the surface of the water, towing the MWV behind it.

According to the choppiness of the body of water over which the system travels, a real risk of immersion by the MWV exists. In order to avoid any incidents and to assist the navigation of the MWV when the latter is being towed, for example, by a propulsion device, the invention provides for the adaptation of the MWV by means of installing a flange 35 on the fluid outlet of the MWV to comprise a step of inserting—between the flange 35 and the end piece 2*b* of a supply channel—a substantially U-shaped linking elbow 36, arranged such as to direct the pressurized fluid at the outlet of said elbow along an axis substantially parallel to the hull 31 of the MWV towards the front of said MWV. Thus, the MWV can be towed from the front and the aforementioned disadvantages are avoided. In order to prevent the supply channel from obstructing all or part of the fluid intake of the vehicle when said channel is positioned along the hull of the vehicle at the risk of altering the compression performance of the vehicle, the invention provides for the elbow to be arranged advantageously such as to shift the supply channel sidewise relative to the axis of the fluid outlet while directing said fluid outlet towards the front of the vehicle along the hull of the latter.

In order further to improve the towing of the MWV by the bow of the latter and to reduce the towing force applied to the elbow 36, the invention provides—as indicated in FIG. 2—for fastening the supply channel 2 to the bow of the MWV, for example by means of the towing hook 37 that is generally found on the bow of any MWV. This forms a guide for the supply channel from the stern to the bow of the MWV, while maintaining the seaworthiness and compression capacity of the MWV.

Figure 3:
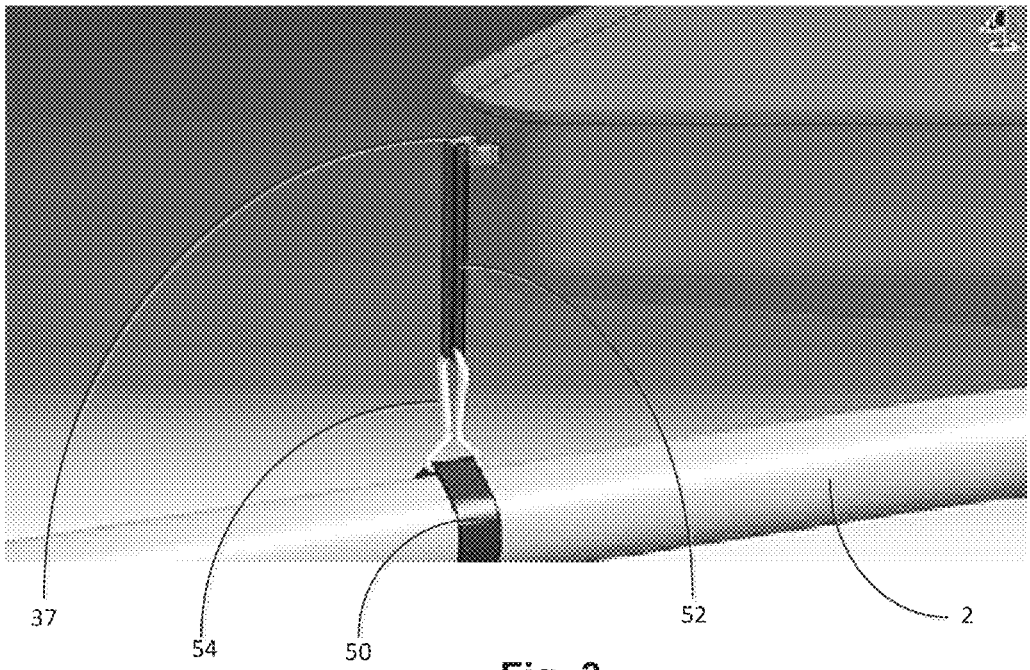
FIG. 3 is a more detailed perspective view of an arrangement for attaching the supply channel to the bow of the water vehicle.
Figure 4:
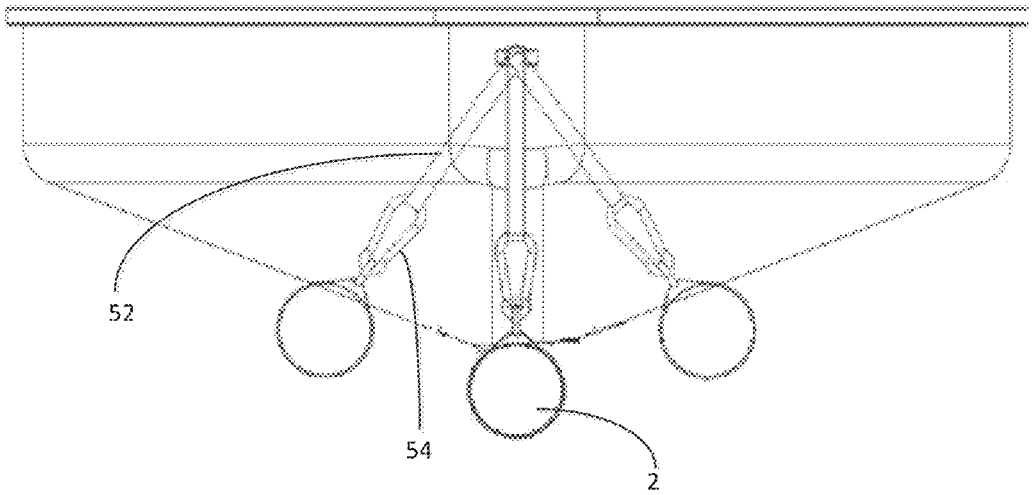
FIG. 4 is a front view of the arrangement shown in FIG. 3.
Figure 5:
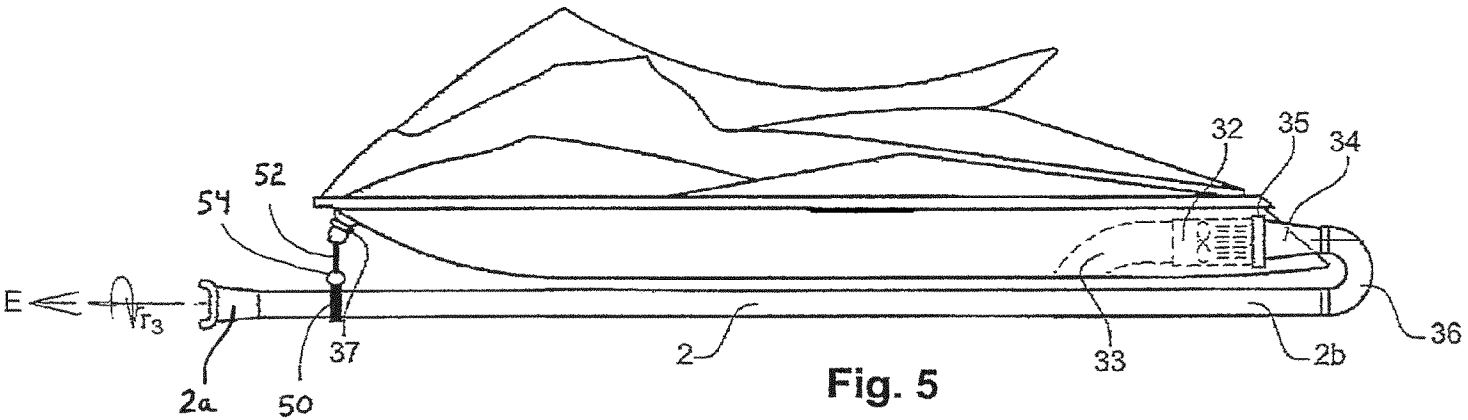
FIG. 5 is a side view of the motorized water vehicle with the arrangement shown in FIG. 3.

A more detailed view of an arrangement for attaching the supply channel to the bow of the MWV is illustrated in FIGS. 3-5. In this embodiment, the supply channel 2 comprises a conduit that is separate from the hull of the MWV, such as a flexible hose or pipe. A first strap 50 surrounds the exterior of the supply conduit, in the vicinity of the front of the vehicle. In one implementation, the strap 50 can be loosely fitted around the supply conduit, which enables the strap to slide along the supply conduit to accommodate MWVs of different lengths. For example, the circumference of the strap can be about 10-15% longer than the outer circumference of the supply conduit. The loose fitting also permits the strap to freely rotate about the longitudinal axis of the supply conduit in accordance with the movements of the passenger relative to the MWV.

A second strap 52 is attached to the bow of the MWV, e.g. to the towing hook 37. The second strap can take a variety of forms, e.g. a flat web material, a length of cord or rope, or any other length of material that is resistant to stretching. The two straps 50 and 52 are connected to one another. Preferably, the connection is made in a releasable manner, so that the straps can be easily detached from one another to facilitate assembly and disassembly of the supply conduit to the MWV. For this purpose, a suitable buckle 54, such as a carabiner, can be used to connect the two straps to one another.

The length of the strap 52 is preferably set so that, when the components are connected as shown in FIG. 3 and at rest, the supply conduit extends with a substantially horizontal orientation beneath the hull 31, along the entire length of the hull, as shown in FIG. 5. To this end, the strap 52 can be made adjustable in length, to accommodate various MWVs having different hull depths and/or different locations of the towing hook 37 relative to the bottom of the hull.

By means of such an arrangement, the supply conduit 2 maintains a natural position below the water line, and does not exert excessive downward force on the bow of the vehicle which could cause it to capsize. Moreover, as shown in the front view of FIG. 4, the strap 52 allows the supply conduit to move freely from side to side relative to the vehicle, so that the maneuverability of the platform 11 and the passenger is not constrained.

Figure 6:
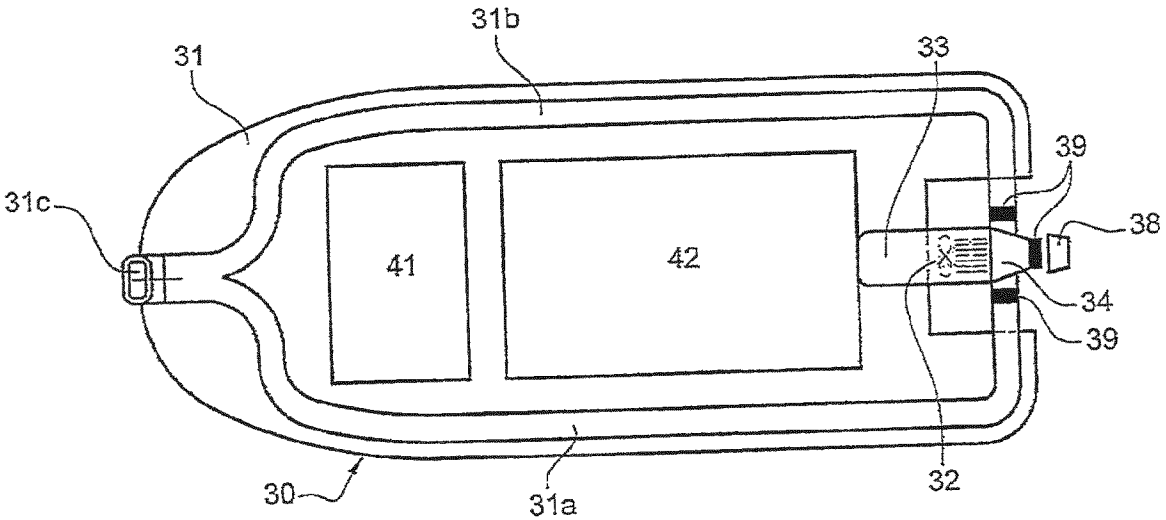
FIG. 6 shows a top view of an alternative embodiment of a remote compression station in the form of a water vehicle according to the invention.

The invention further relates to an MWV in which the top view is schematically shown in FIG. 6. Such an MWV comprises—like the MWV described previously in relation to FIG. 2—a hull 31, a propulsion means 32 using a turbine to compress a fluid ingested from an intake located under the hull and expelling said fluid thus pressurized from a fluid outlet 34 at the rear of the vehicle, for example according to the MWV depicted in relation to FIG. 6, in the form of a cone engaging with a steering mechanism 38. An MWV according to the invention also comprises a means for collecting all or part of the fluid compressed by the means 32 and for transporting said pressurized fluid to the front of the MWV. Such an MWV also comprises a means for supplying said pressurized fluid from the bow of the MWV. Thus, according to FIG. 6, distribution valves 39 make it possible to allow the pressurized fluid to escape conventionally from the fluid outlet 34 and thus to propel the MWV forwards, or to divert said fluid from the fluid outlet 34 in order for the fluid to be transported—for example by means of at least one longitudinal recess 31*a* and/or 31*b* made in the hull 31 of the MWV. Thus, as suggested in FIG. 6, two recesses 31*a* and 31*b* surround the engine block 42 and a fuel tank 41 for laterally transporting the pressurized fluid under the feet of the pilot of such an MWV. On the bow of the MWV, the recess or the plurality of recesses converge and lead into the means for supplying the fluid. As an example, such means consists of a bow fitting 31*c* engaging with the recess or recesses 31*a* and 31*b* and capable of receiving an end piece 2*b* of a supply channel 2, not shown in FIG. 6. An engagement between a propulsion device and such an MWV in accordance with the invention can be implemented through the supply channel 2. The means 31*c* for distributing the pressurized fluid advantageously located on the bow of the MWV enable the latter to be able to be towed from the bow, thus promoting the buoyancy of the MWV.

Advantageously in order to prevent the movements of a device according to the invention from straining the supply pipe 2 by twisting, the invention provides for the bow fitting or the end piece 2*b* of said channel to be interconnected by a knuckle or pivot joint, such as to enable free rotation about an axis substantially parallel to the longitudinal axis of the supply channel 2.

In a similar manner, with reference to the embodiments of FIGS. 2-5, the end piece 2*a* at the forward end can be connected to the main body of the supply channel 2 by means of a pivotable or rotatable coupling. Such a coupling enables free rotation r3 of the end piece, relative to the main body of the supply channel 2, about an axis E that is substantially parallel to the longitudinal axis of the supply channel.

Regardless of the MWV adapted according to the invention, the latter provides that said MWV should comprise a means for regulating the compression power of the propulsion means thereof from a remote control. Thus, the means for controlling the power of a remote compression station of a propulsion device can be made to interact with said means for adjusting the power of an MWV thus adapted. By means of a communication means (fixed or wireless) for carrying a control signal issued by the propulsion device and sent towards the MWV acting as a remote compression station, a passenger of said device can remotely control the power of the MWV and thus adapt the movements performed using the propulsion device.

Figure 7:
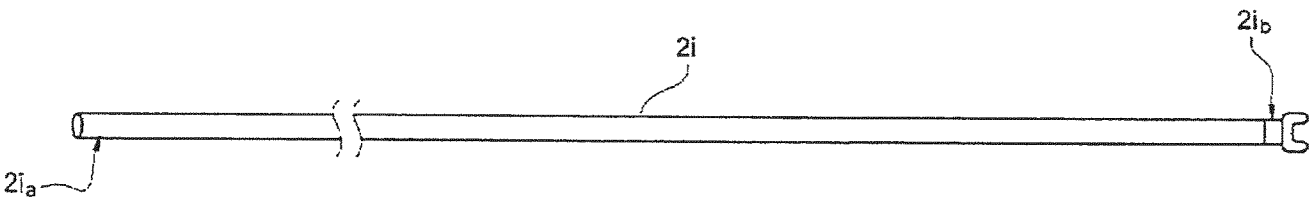
FIG. 7 describes a modular embodiment of a pressurized-fluid supply channel.

As shown in FIG. 7, a supply channel 2—intended for being connected respectively to a third device, for example the propulsion device 10 according to FIG. 1 and to a remote compression station in the form of an MWV in accordance with the invention—can be modular. Said channel can comprise a plurality of elements 2*i* that can be interconnected by means of couplings 2*ib* or free end pieces 2*ia*. Thus, the length of the supply channel 2 can vary according to the intended use thereof. It is also possible to connect, on demand, a propulsion device or any other third device in which a first channel element 2*i*1 is already connected to an MWV adapted using a method according to the invention and which comprises a first length of the supply channel 2*i*2 in order to supply a pressurized fluid. The packaging and transport of the elements of a propulsion system according the invention are thus easier.

A large number of recreational or civil and/or military applications are made possible with a propulsion system in accordance with the invention. For example, an MWV can be provided in accordance with the invention which carries a propulsion device and a supply channel in order for the driver of the MWV to be able, on demand, to become a passenger of the device.

The invention should not be limited by the cited examples of use. An MWV according to the invention can thus transform on request into a device for civil or military security: fire-fighting, fluid-draining pumps, etc. It can also be connected to any third device that needs to be supplied with a compressed fluid.

The use of a motorized water vehicle as a remote station offers increased safety compared with using dedicated stations, as provided in the prior art. Indeed, whether this vehicle is adapted according to a method depicted in connection with FIG. 2 or a vehicle designed according to an embodiment depicted in connection with FIG. 6, the invention provides for the vehicle advantageously to be able to return easily to its original function. Thus, the elbow 36 and/or the flange 35 can be easily disconnected from the fluid output 34 in order for the user of a propulsion system according to the invention to be able to disconnect the propulsion device 10 (or any other third device supplied with pressurized fluid) from the vehicle and to use the latter to return to dry land, for example, following a failure or at the end of a mission or an exercise. The same applies to the bow fitting 31*c*, which can advantageously be provided in order to make it easy to disconnect the supply channel from said fitting. Thus regardless of the intended use (recreation, competition, civil or military security), the invention enables reversible adaptation of a motorized water vehicle such as to be used as a compression station or as a vehicle.

Accessories for further improving the recreational nature or the operating conditions of such an MWV may also be provided: lighting, navigation means, etc.

The invention claimed is:

1. A motorized water vehicle, comprising:

a hull, a turbine to pressurize a fluid ingested from an intake and expel the pressurized fluid from a fluid outlet at the rear of the vehicle, a flange attached to the fluid outlet for collecting at least a part of the pressurized fluid, a supply conduit connected to the flange and disposed beneath the hull to transport the pressurized fluid towards the front of the vehicle, a first strap surrounding the supply conduit at a location in the vicinity of the front of the vehicle, and a second strap connected to the front of the vehicle and to the first strap, so as to support the supply conduit, said second strap having a length that enables the supply conduit to maintain a substantially horizontal orientation along the length of the hull.

2. The vehicle according to claim 1, wherein the first strap is slidable along the length of the supply conduit.

3. The vehicle according to claim 1, wherein the second strap has a length that is adjustable.

4. The vehicle according to claim 1, wherein the second strap is connected to the first strap by means of a releasable connector.

5. The vehicle according to claim 1, wherein the second strap is connected to a tow hook at the front of the vehicle.

6. The vehicle according to claim 1, further including an end piece connected by a rotatable coupling to an end of the supply conduit remote from the flange, to enable the end piece to rotate substantially about the longitudinal axis of the supply conduit.

7. A propulsion system, comprising a propulsion device having a body arranged for holding a passenger and engaging with the supply conduit connected to a motorized water vehicle according to claim 1.

8. A propulsion system according to claim 7, further comprising a throttle for controlling the fluid-compression power of the vehicle, and a communication system for transmitting a command issued by a user piloting the propulsion device to the throttle for controlling the compression power of the motorized water vehicle.

9. A fluid delivery system for use with a motorized water vehicle, comprising:

a flange that is attachable to a fluid outlet of a motorized water vehicle, for collecting pressurized fluid expelled through the outlet, a supply conduit connected to the flange and configured to be disposed beneath a hull of the vehicle to transport the pressurized fluid towards the front of the vehicle, a first strap surrounding the supply conduit at a location in the vicinity of the front of the vehicle, and a second strap configured to be connected to the front of the vehicle and to the first strap, so as to support the supply conduit, said second strap having a length that enables the supply conduit to maintain a substantially horizontal orientation along the length of the hull of the vehicle.

10. The fluid delivery system according to claim 9, wherein the first strap is slidable along the length of the supply conduit.

11. The fluid delivery system according to claim 9, wherein the second strap has a length that is adjustable.

12. The fluid delivery system according to claim 9, wherein the second strap is connected to the first strap by means of a releasable connector.

13. The fluid delivery system according to claim 9, further including an end piece connected by a rotatable coupling to an end of the supply conduit remote from the flange, to enable the end piece to rotate substantially about the longitudinal axis of the supply conduit.

* * * * *